US010046878B2

(12) United States Patent
Knoke et al.

(10) Patent No.: US 10,046,878 B2
(45) Date of Patent: Aug. 14, 2018

(54) METHOD AND DEVICE FOR PRODUCING AND FILLING PACKAGING MEANS

(75) Inventors: Thomas Knoke, Bielefeld (DE); Ruediger Grosse-Heitmeyer, Westerkappeln (DE); Thomas Hawighorst, Hasbergen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 850 days.

(21) Appl. No.: 13/642,927

(22) PCT Filed: Apr. 28, 2011

(86) PCT No.: PCT/EP2011/056734

§ 371 (c)(1), (2), (4) Date: Oct. 23, 2012

(87) PCT Pub. No.: WO2011/135025

PCT Pub. Date: Nov. 3, 2011

(65) Prior Publication Data

US 2013/0036710 A1 Feb. 14, 2013

(30) Foreign Application Priority Data

Apr. 29, 2010 (DE) ..... 10 2010 028 394

(51) Int. Cl.
*B65B 9/13* (2006.01)
*B65B 61/14* (2006.01)
(Continued)

(52) U.S. Cl.
CPC ..... *B65B 61/14* (2013.01); *B65B 1/02* (2013.01); *B65B 9/13* (2013.01); *B65B 43/30* (2013.01);
(Continued)

(58) Field of Classification Search
CPC .... B65B 9/13; B65B 9/14; B65B 1/02; B65B 61/14; B65B 61/16; B65B 1/46;
(Continued)

(56) References Cited

U.S. PATENT DOCUMENTS 3,058,272 A * 10/1962 Huber ..... B65B 61/28 53/138.5
3,334,466 A * 8/1967 Scholle ..... B65B 9/13 53/451
(Continued)

FOREIGN PATENT DOCUMENTS

DE 1 586 013 4/1970
DE 2 263 624 7/1974
(Continued)

*Primary Examiner* — Stephen F Gerrity
*Assistant Examiner* — Joshua Kotis
(74) *Attorney, Agent, or Firm* — Jacobson Holman, PLLC.

(57) ABSTRACT

A method for the production and filling of packaging includes unwinding flattened tubular film material from a roll along a primary axis of symmetry thereof, providing the tubular film material via a welding and separating process with a first lateral welding seam perpendicular relative to the axis, and separating the tubular film material along a separation line to provide a hose section. The hose section open at one side is filled, and the still open other side of the hose section is provided with a second lateral welding seam. Two subsequent separation lines are inserted in the hose section at a distance that is less than the distance between the two edges of the hose.

15 Claims, 4 Drawing Sheets

(51) Int. Cl.

| | |
|---|---|
| ***B65B 1/02*** | (2006.01) |
| ***B65B 43/30*** | (2006.01) |
| ***B65B 43/46*** | (2006.01) |
| ***B65B 51/14*** | (2006.01) |
| ***B65B 51/30*** | (2006.01) |
| *B31D 5/04* | (2017.01) |
| *B65B 61/28* | (2006.01) |

(52) U.S. Cl.
CPC ..... *B65B 43/465* (2013.01); *B65B 51/146* (2013.01); *B65B 51/30* (2013.01); *B31B 2219/909* (2013.01); *B31B 2219/923* (2013.01); *B31B 2237/20* (2013.01); *B31D 5/04* (2013.01); *B65B 61/28* (2013.01)

(58) Field of Classification Search
CPC ..... B65B 43/465; B65B 43/30; B65B 51/30–51/306; B31B 2219/909; B31B 2219/9093; B31B 2219/9096; B31B 2237/60; B65G 2201/0238; B65G 41/002; B65G 41/005; B65G 19/28; B65G 17/10; B65G 15/40
USPC ..... 53/450–452, 413, 134.1
See application file for complete search history.

(56) References Cited

U.S. PATENT DOCUMENTS 3,508,374 A 4/1970 Bertoglio
3,568,576 A * 3/1971 Lehmacher ..... A45C 3/04 383/10
3,792,562 A 2/1974 Goransson
3,908,335 A * 9/1975 Giannelli ..... B65B 1/02 53/138.4
3,977,483 A * 8/1976 Greanias ..... G01G 15/04 177/1
4,030,270 A * 6/1977 Arnold ..... B65B 65/02 53/567
4,069,646 A * 1/1978 Slomp ..... B65B 51/07 53/138.5
4,353,196 A * 10/1982 Beer ..... B26D 1/095 383/8
4,510,736 A * 4/1985 Muller ..... B65B 1/02 53/284.7
4,781,471 A * 11/1988 Sengewald ..... B31B 19/74 229/69
4,894,975 A * 1/1990 Ausnit ..... B31B 19/90 53/133.1
5,007,528 A * 4/1991 Hideharu ..... B65G 15/60 198/823
5,313,766 A * 5/1994 Rimondi ..... B29C 65/229 53/245
5,448,879 A * 9/1995 Concetti ..... B65B 1/02 53/284.7
5,758,473 A * 6/1998 Patelli ..... B65B 9/20 222/541.6
5,823,933 A * 10/1998 Yeager ..... B31B 19/90 493/210
6,269,943 B1 * 8/2001 Mott ..... B65G 15/08 198/823
6,428,456 B1 * 8/2002 Visona' ..... B65B 9/2049 493/129
6,609,353 B1 * 8/2003 McMahon ..... B31B 19/90 53/133.4
6,789,374 B1 * 9/2004 Bois ..... B31B 19/90 493/212
2002/0102032 A1 * 8/2002 Sturgis ..... B65D 33/08 383/10
2002/0177380 A1 * 11/2002 Forman ..... B29C 66/81427 442/366
2003/0177739 A1 * 9/2003 Lewis, Jr. ..... B65B 9/20 53/425
2004/0131285 A1 * 7/2004 Shepard ..... B31B 19/90 383/120
2004/0238128 A1 * 12/2004 Giro Amigo ..... B65B 5/022 156/494
2005/0284107 A1 * 12/2005 Concetti ..... B65B 61/16 53/413
2006/0030470 A1 * 2/2006 Voss ..... B65B 61/16 493/194
2006/0126975 A1 * 6/2006 McKellar ..... B65B 61/02 383/200
2007/0289262 A1 12/2007 Koehn
2007/0294982 A1 * 12/2007 Knoke ..... B65B 1/36 53/451
2009/0235616 A1 * 9/2009 Combrink ..... B65D 75/566 53/456
2009/0308028 A1 12/2009 Koelker et al.
2010/0226600 A1 * 9/2010 Steele ..... B65D 75/5866 383/210
2011/0239592 A1 * 10/2011 Willey ..... B26F 1/384 53/450
2012/0085479 A1 * 4/2012 Goto ..... B65B 9/2028 156/66

FOREIGN PATENT DOCUMENTS

DE 2 420 642 11/1974
DE 25 28 703 1/1976
DE 3 624 311 1/1996
DE 10 2004 034 489 4/2006
DE 10 2005 018545 11/2006
DE 10 2005 018548 11/2006
EP 1 201 539 5/2002
EP 1 623 926 2/2006
EP 2 024 231 2/2009
GB 1150368 A * 4/1969 ..... B29C 53/10

* cited by examiner

METHOD AND DEVICE FOR PRODUCING AND FILLING PACKAGING MEANS

CROSS-REFERENCE TO RELATED APPLICATIONS

This is a national stage of PCT/EP11/056734 filed Apr. 28, 2011 and published in German, which has a priority of German no. 10 2010 038 394.0 filed Apr. 29, 2010, hereby incorporated by reference.

BACKGROUND OF THE INVENTION

1. Field of Invention

The invention relates to a method and a device for producing and filling packaging means.

2. Description of the Prior Art

Various methods are known to produce and fill packaging means. Machines are mentioned in various technical fields, which produce and fill sealable and sealed packaging means, FFS machines (form, fill, and seal machines). However the operating fashion and the capacity of these machines vary to a large extent in different technical fields. When the quantity and the mass of the packaging means per time unit produced and filled is used as an expression of capacity, in this context FFS machines to fill industrial bulk goods, such as described in DE 10 2004 034 489 A1, EP 1 201 539 B1, or EP 1 623 926 A2, are of a leading role: using such machines it is possible to fill more than 2000 bags per hour with granular bulk goods and to seal these bags. Many of these bags weigh 50 kg or more. The above-mentioned FFS machines generally perform the following processing steps to form, fill, and seal the bags.

- a flattened tubular film material, comprising a primary axis of symmetry and two hose edges parallel in reference thereto is unwound from a roll in the direction of the primary axis of symmetry of the hose,
- the tubular material is provided with a first lateral welding seam, perpendicular in reference to the tubular axis by way of a welding and separating process and separated along a separating line extending parallel to said lateral welding seam so that individual tubular sections develop open at one side,
- the tubular sections open at one side are filled in the filling station via gravity through its still open end with a material to be filled in,
- the still open end of the unilaterally open tubular section is provided with a second welding seam, also extending perpendicular in reference to the axis of the hose.

Recently similar machines have become known which fill powdered bulk goods, tending to fog, in a similar fashion. Frequently these machines for filling the material to be filled in comprise a screw in order to prevent, by the unrestricted dropping of the bulk good, excessive fogging from occurring, which might then compromise the lateral welding. Such a machine is presented in EP 2 024 231 B1.

Similar methods are used in the field of consumer goods, however it is generally impossible to reach the above-mentioned filling speeds. The circumstance is unfortunate, because it renders the respective packages and products more expensive.

SUMMARY OF THE INVENTION

The objective of the present invention therefore comprises to suggest a method and a device by which suitable packaging means can be produced and filled with consumer products and which lowers the production and filling costs for this packaging.

The objective is attained in the features of the inventive method and device described herein.

When implementing the above-mentioned invention here bags develop, which have been filled through one of their two wider sides.

The increase in efficiency achieved in this method can be explained partially such that the bulk goods, filled into the bags, are inserted by gravity through a wide opening into said bags. The still open opening, through which the filling occurred, is then sealed by a lateral welding seam, as mentioned above.

The two broad sides of the bags created in this manner are formed by the lateral welding seams. The narrower sides are formed by the original edges of the hose. It has proven advantageous for the hose underlying the production of bags to show a lateral fold at least at one of its edges, preferably at both of them. In this case, the lateral fold, frequently already unfolded due to the filling process, can serve as a standing base of the bag. The bag can therefore stand on one of its narrow sides.

It is advantageous to provide the bag with an opening aid. This may be inserted into the edge region of the hose, before or after its separating. Such an opening aid may represent a perforation. In particular in the food sector such perforations reaching into the material are undesired, though. Here, alternative methods may be used for weakening the material, or a material may be used which is weakened at a certain position right from the start. Frequently it is advantageous to insert such opening aids into the hose during the formation of said hose. For example, in a hose [forming] machine a perforating knife may run at the respective position of the hose circumference. This position may be the central fold of the lateral fold. Components of resealing means, such as slider bars, may be inserted into the hose material in the frequently continuous hose formation. Other components of such a resealing means, particularly those allocated individually to a single bag, such as a slider head, may be inserted when the hose material is moved intermittently before or after separation. This is the case in many parts of the FFS machine.

In this phase it is also possible to perform corner welding seams at one or both edges of the hose material, thus in an area of the narrow side of the bag. In general, firstly two such welding seams shall be performed at least at one side, because this benefits the formation of a standing base. At least the corner welding seams in the area of the opening, through which the bag is filled, may advantageously be performed after or during the sealing process of said opening. It is advantageous to provide the separating lines and/or lateral welding seams forming the edges of the bag at their longer sides with a so-called sealing seam.

In general, in light of the term "sealing seam" once more the term of "separating line" and "lateral welding seam" shall be explained. Here, in a FFS process of the type described at the outset the lateral welding seam and the separating cut are performed during the separation of the hose parts at a short spatial distance from each other (a few millimeters). The separating cut shall occur at the side of the lateral welding seam located at the initially unsealed opening of the next hose section. This way it is ensured that this opening remains open for the filling process.

However, this technology leads to the two loose ends of the bag material projecting beyond the lateral welding seams. In order to design this material projection somewhat appealing the separating line and the lateral welding seam shall extend parallel in reference to each other.

In order to avoid the above-mentioned material overhang at least at one edge of the hose part there are several options available, for example:

A subsequent sealing and thus connection of the material overhang with a dull sealing tool.

The application of a separating welding seam in which the welding seam and the separating line coincide or follow each other immediately. For example ultrasound welding tools may be used to generate such welded separating seams.

When a welded separating seam is provided it must be assumed that both the separating line and the welding are aligned perpendicular in reference to the axis of symmetry of the hose in the sense of the present publication. For this purpose, this publication shall also consider separate welding and separating devices and welding separating devices to be equivalent.

In FFS machines of the type in question here the term of operating width is known representing the distance between the edges of the flattened hose, thus the width of the hose. The maximum operating width of such a FFS machine is an important machine feature, which is determined by the different machine components of the machine. These machine components include, among other things, the welding and separating devices, various transportation devices—here the grasping devices shall not be neglected—and the unwinding station. Of course, the maximum operating widths of these components are adjusted to each other. In general, the maximum operating width of the machine may depend on the machine components with the smallest operating width.

In the above-mentioned FFS machines the bottom of the bag and here primarily the still fresh first lateral welding seam is supported by a bag bottom support device during the filling process. This bag bottom support device frequently serves simultaneously for the removal of the bags out of the filling station. In this case, the bag bottom support and transportation device is frequently embodied as a conveyer belt 24. Here, other mobile and immobile bag bottom support devices may be used as well.

In machines according to the invention the maximum operating width of the device is greater than or identical to the distance (A) shown by the support surface of the bag bottom support device and the opening of the hose sections open at one side in the filling station in the vertical direction (y) in reference to each other. If there is a difference in height inside the support area of the bag bottom support device, it is advantageous to use the portion of the area supporting the fresh lateral welding seam to measure the distance. Furthermore, it has proven advantageous to use the lowest part, in the vertical direction, of course, of the activated or potentially activated contact area of the support surface of the bag bottom support device for this purpose. Here, the activated area represents the area covered by the bag bottom at the respectively adjusted operating width. The potentially activated area represents the area covered by the bottom of the bag at the maximum operating width.

In order to produce particularly embodied bags it is beneficial to provide devices to fasten handles and loops, particularly at one of the two edges. For reasons discernible from the description of the matter at hand this also applies for the additional welding devices. They may implement welding seams into the hose or into the already separated individual hose parts, extending parallel or even flush with the hose end. Particularly the above-mentioned welding seams (other connection seams, such as produced for example by inserting extruded material, are also considered here) may also be inserted into the hose material while it is continuously conveyed, which is particularly advantageous in the hose formation device.

In order to produce and fill particularly formed bags it is advantageous to position the filling nozzle and/or the weighing container of the scale off-centered in reference to the wide side of the bag, thus the respective operating width of the machine. This means that during the filling process the symmetry lines of the filling nozzle and/or the weighing container are displaced in reference to the axis of symmetry of the hose part, existing prior to the separating of the primary axis of symmetry of the film hose, in the direction of the width of the hose part. It is also advantageous to position the shaker, frequently provided underneath the area to potentially be activated, which shall lead to a material compacting in the recently filled bag, along the direction of the bag width off-centered in reference to the above-mentioned axis of symmetry of the hose part.

Additional exemplary embodiments of the invention are discernible from the description and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
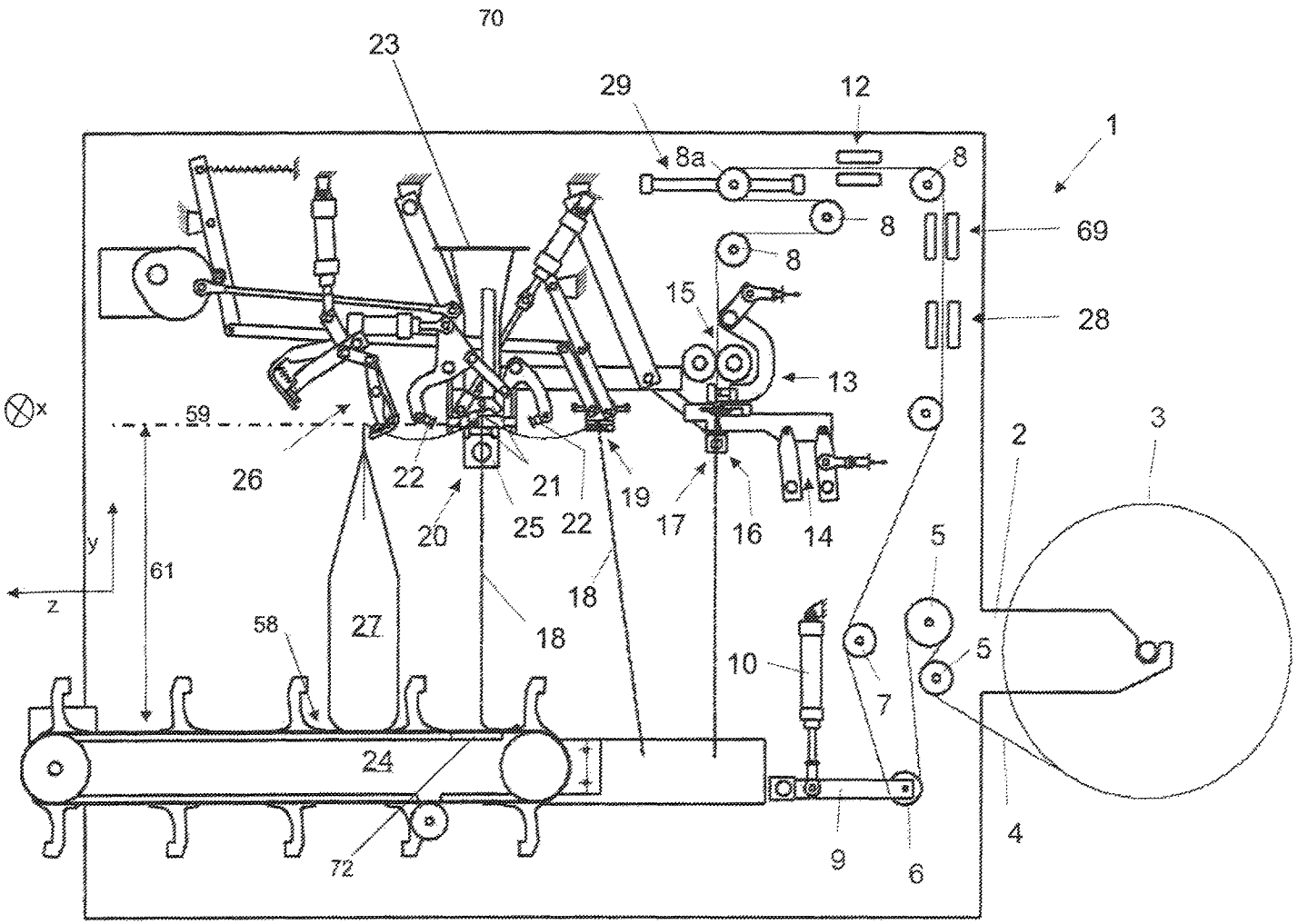
FIG. 1 side view of a FFS machine

FIG. 1 shows a FFS machine. This device 1 comprises a support arm 2 supporting a roll 3 with a tubular film 4. In FIG. 1 the tubular film 4 comprises lateral folds 41, not shown. The transportation rolls 5, which partially may be driven, allow for a generally continuous unwinding of the tubular film 4. The lever 9, impinged via a piston-cylinder unit 10 with a load, carrying a deflection roll 6 and overall frequently called a dancer roll, and the conveyer roll 7, 8 and the pair of feed rolls 15 overall allow in a common fashion for the tubular film 4 to move forward intermittently clocked over its further traveling path. The conveyer roll **8*a* is a component of a register device 29, by which the length of the transportation path of the tubular film 4 can be adjusted to the format of the later bags. For this purpose the conveyer roll 8*a* is arranged displaceable in reference to the device 1**. For the displacement a manually or electromotively operated spindle drive can be used, known per se.

During the course of the transportation through the device 1 the tubular film 4 passes a station 28 for inserting handle holes 43. This station 28 essentially comprises a punching or cutting tool and a counter stop. It is possible, instead or in addition to this station 28, to provide means for implementing welding seams, for example diagonal or corner welding seams 46 or/and contour welding seams. FIG. 1 additionally indicates, in addition to the station 28 to insert handle holes 43, a station 69 to insert corner welding seams 46. The illustration in FIG. 1 leaves it undetermined if the respective stations 28 and 69 can produce handle holes 23 and/or corner welding seams 46 at both edges 50 and 51 of the tubular material 4 or if they are capable of doing this only at one side 50, 51.

In the first case it is advantageous to equip at least the station 69 such that it optionally generates the corner welding seams 50, 51 at one side 50, 51 or at both sides. This way, using such a device 1 optionally the bags 60, illustrated in the following, which only show corner welding seams 46 on one of their sides 51 or normal FFS bags with four corner welding seams 46 can be produced.

An advantageous manner to add such an optional feature is to allow activating or deactivating at least one processing side via a control device.

Due to the fact that the bag 60 comprises corner welding seams at one of its sides 51 and handle holes 43 at the other side 50 the above statement is also applicable for the station 28 to insert handle holes 43, in principle. However, advantageously it will be frequently abstained from equipping the stations 28 such that they may provide handle holes at both edges 50, 51 of the hose 4. Instead, only one station will be provided at the device 1, producing handle holes at one side of the hose 50. Due to the fact that frequently a handle hole is provided at the same side of the hose 50 as the welding seam 52, one station 28 to insert handle holes 43 can be combined with a device providing the welding seams 52. If such a device is inserted in the device 1, independent from the station 28, the same shall apply for its position in reference to the hose edges 50, 51 and for its way to be controlled as for the station 28.

The punching or cutting process and/or the welding process in these stations here occurs advantageously during the idle phases of the intermittent transportation. The tubular film 4 provided with handle holes 43 is conveyed via additional conveyer rolls 8 to a cooling station 12 in which the welding seams are cooled.

Via the pair of feed rolls 15 the tubular film 4 is pushed through the welding jaws 33 of a lateral welding station 13 and through a lateral cutting station 16. The tools of the lateral welding station 13 and the lateral cutting station 16 can be moved further in a manner not described in greater detail, for example by a parallelogram arrangement 14, in levels perpendicularly in reference to the direction of feed of the tubular film 4 towards it and away from it. After the graspers 17 have engaged the tubular film 4 a tubular section 18 is separated in the lateral cutting station 16 from the tubular film 4 above the grasper 17. Simultaneously, above the cutting edge a lateral welding seam 42 is applied at the tubular film 4 in the lateral welding station 13, which [seam] represents the bottom or the head of the hose section 18 to be formed in the next operating phase of the device 1. Accordingly head seams are generated in the lateral welding station 13. In general, the production of the head or bottom seams may not only occur by a lateral welding, although preferred, but other bonding measures, for example adhesion, are also possible.

The graspers 17 convey the hose section 18 to a transfer point at which additional graspers 19 grasp the hose section 18 and transport it to a filling station 20. Here, the hose section 18 is handed over to stationary graspers 21 and opened by suction devices 22 so that the material to be filled in, guided through the filling nozzles 23, can enter the hose section 18. Here, the hose section 18 rests with its bottom end on a conveyer belt 24 so that the hose section 18 during the filling process is not excessively stressed along its longitudinal edges. Additional graspers 25 convey the filled hose section to the head or bottom seam welding station 26 in which the hose section 18 is sealed with a head and/or bottom welding seam and thus forming a finished bag 27. The sealing of the hose section 18 in its head section may also occur by any other sealing method. The finished bag 27 is guided by a conveyer belt 24 out of the device 1. Here the bag 27 is much higher (in the y-direction) than wide (in the x-direction).

As already mentioned in the introductory description, under certain conditions the method according to the invention can also be performed in a device shown in FIG. 1:

The distance 61 between the opening 62 of the hose section 18 and the support surface 58 and the height 59 of the bag opening 62 (here shown in a dot-dash line) must be adjustable or determined such that it [the distance] 61 is smaller or equivalent to the maximum operating width of the device 1.

Figure 5:
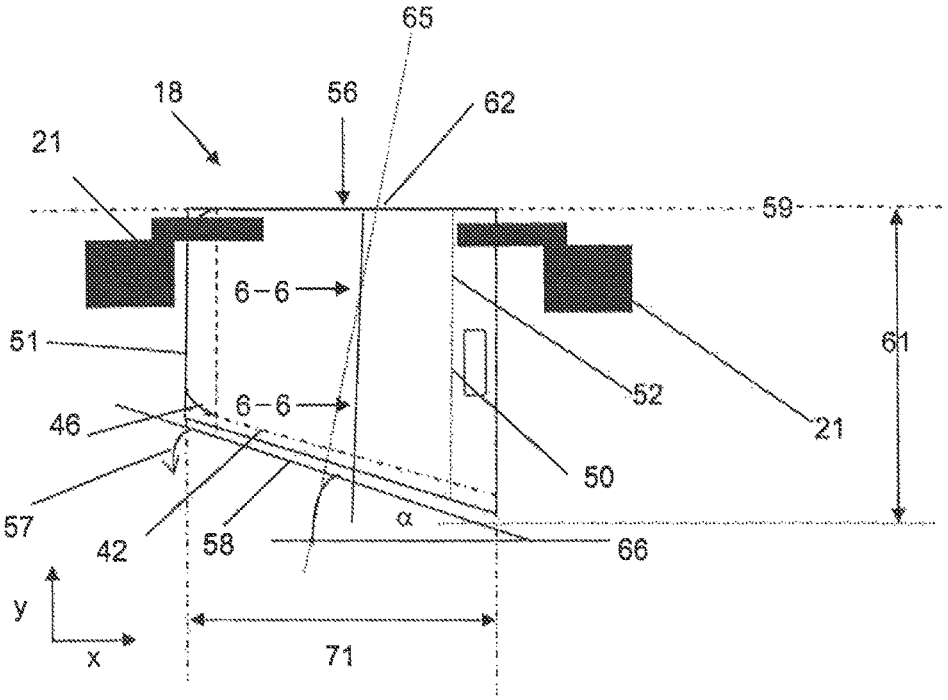
Figure 6:
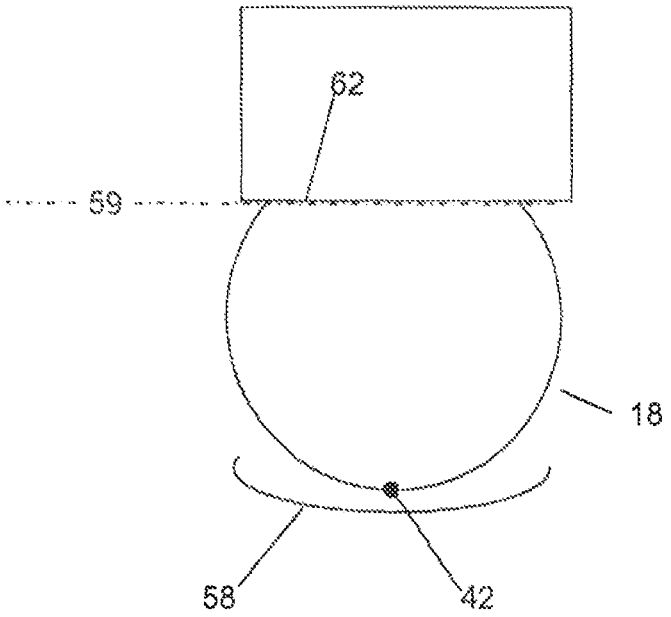

However, FIG. 5 shows a support surface 58 comprising different heights because it is inclined at an angle $\alpha$ in reference to the horizontal 66, and due to the fact that it is additionally embodied groove-like in the direction of the bag width 64, as shown in FIG. 6. In such a case it is frequently advantageous to measure the distance 61 from the lowest part of the contact area 71 of the support surface 58 to be activated to the opening of the hose section 18 in the filling position. This is illustrated in FIGS. 5 and 6. Here the contact surface to be activated represents the area covered by the bottom of a bag when operation occurs at the maximum operating width.

In addition to these features some other components of the device are advantageous for a production of the bags described in the following:

Corner welding devices, devices for inserting a handle 28, and/or devices for providing at least one welding seam or sealing seam 52 which preferably are provided at an edge of the film hose and/or individual hose sections. They may also assume the position of the station sketched in FIG. 1 to insert handle holes 43, however they may also be applied later in the direction of transportation of the tubular film 4. The position of this station in reference to the hose edges and the potential activation of this station have already been discussed.

Among other things, due to the handle holes 43 and the longitudinal seams 52 the material acceptance of the hose section 18 and its weight distribution are frequently not symmetrical in reference to the primary axis of symmetry 65.

For these reasons it may also be advantageous to position the filling nozzle 23 of the filling station in reference to the filling position of the hose section 18 in the filling station along the width of the bag 64 such that the line of symmetry 70 of the filling nozzle 23 and the primary line of symmetry 65 of the hose 4 are off-set in reference to each other. This applies for the line of symmetry of the weighing container. The shaker may also be arranged off-centered in reference to the primary line of symmetry 65 of the hose 4.

Furthermore it is advantageous, among other things due to the formation of many preferred bags 60 explained in the following using FIG. 4, for the central area of the support surface 58 to show an angle α in reference to the horizontal 66. This situation is shown in FIG. 5. It is advantageous to provide the FFS machines with pivotal support surfaces, indicated by the arrow 57. In a device 1 as shown in FIG. 1 it is possible to pivot the support surface 58 in reference to the conveyer belt 24. However, the entire conveyer belt 24 may also be "tilted" in the desired fashion. FIG. 1 shows a shaker 72 arranged underneath the filling station under the conveyer belt and capable of causing the oscillation of the bag 28 in the filling station in order to compact the material filled in.

Figure 4:
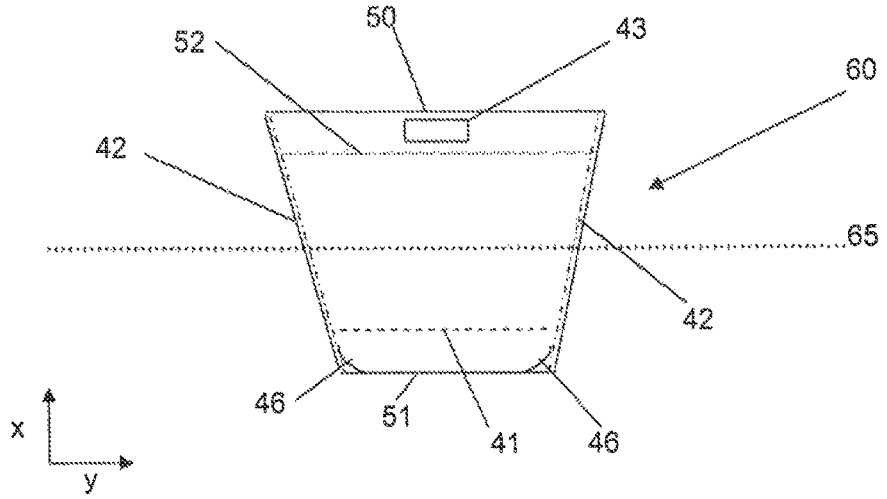

Bags 60 as shown in FIG. 4 form a predominantly circular cylindrical cross section after being filled. Accordingly it is advantageous to embody the support surface shown planar in FIG. 5 like a bowl or groove. Due to the corner welding seams 46 the filled bag 60 shows a trapezoidal form in a side view; this means that the diameter in the bag shown in FIG. 4 increases upwardly, i.e., here in the x-direction. The cross section of the bag 60 in FIG. 4 therefore behaves partially like an upside-down frustum. It is advantageous for the support surfaces 58 to be adjusted in their cross-sectional form also to the production of these bags and formed like a negative of this frustum of the bag 60.

Figure 2:
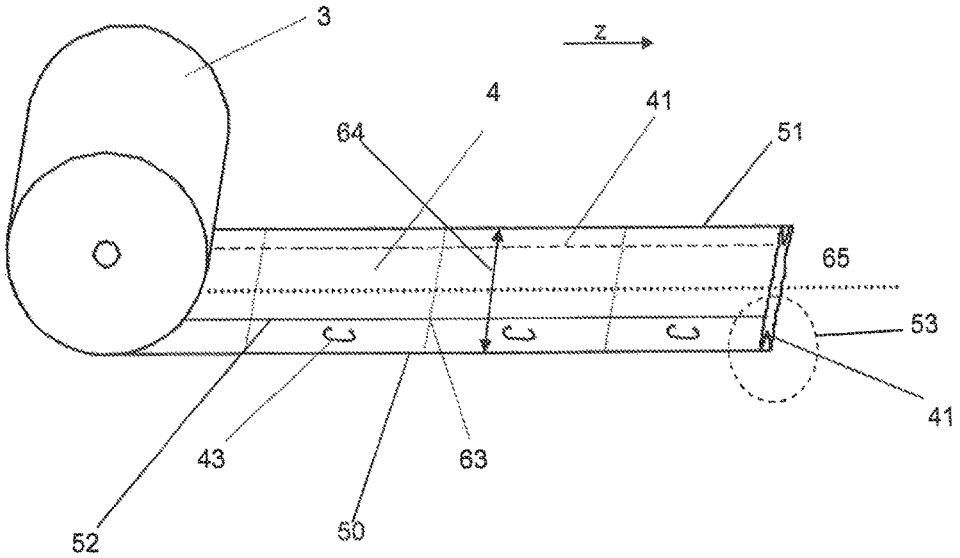
FIG. 2 a film hose suitable for performing the method according to the invention FIG. 3 a first hose section open at one side in its position in a filling station FIG. 4 a bag produced via a method according to the invention FIG. 5 a second hose section open at one side in its position in a filling station FIG. 6 a cross section of objects shown in FIG. 5 in the direction indicated by the arrows 6-6.

Now, once more a detailed description of FIGS. 2 through 5: A film hose 4 suitable for performing the method according to the invention is shown in FIG. 2. In FIG. 2 it is shown, for reasons of clarity, how the film hose 4 is pulled off the roll 3 in the direction of its primary axis of symmetry (dot-dash line) 65. This hose 4 shows a width 64 between its edges 50 and 51. In order to produce a bag using the method according to the invention it is sufficient for the hose to represent an unprocessed flattened or laterally folded hose.

The hose shown in FIG. 2 comprises some additional features, though, such as the handle holes 43 and the longitudinal seam 52. For example the longitudinal seam 52 may be produced during the formation of the hose by adding extruded material. It connects the walls of the hose 4 to each other and prevents in the later produced bags 60 material filled in from escaping through the handle holes 43 or being ventilated via the handle holes. When the edge 50 of the hose 4 is equipped with a lateral fold 41, as sketched in the dot-dash circle 53, it is possible to provide four material layers in the proximity of the handle holes 43, which causes particular stability. In this case it is advantageous to expand the lateral fold 41 to the seam 52. At this position both sides of the lateral fold then would then be connected to the exterior wall of the hose and thus sealed.

However it is also possible to waive the lateral folds 41 at the edge 50 and here to provide a simple fold, which is sealed with a sealing seam 52 to form the later interior of the bag. This embodiment of the bag with one lateral fold 41 at the other edge 51 of the hose 4 can be combined advantageously. The area of the lateral fold 41 at the edge 51 later forms the bottom of the bag 60 and improves its standing features. The dot-dash lines 63 indicate the position of the later separating cuts and lateral welding seams 42.

Figure 3:
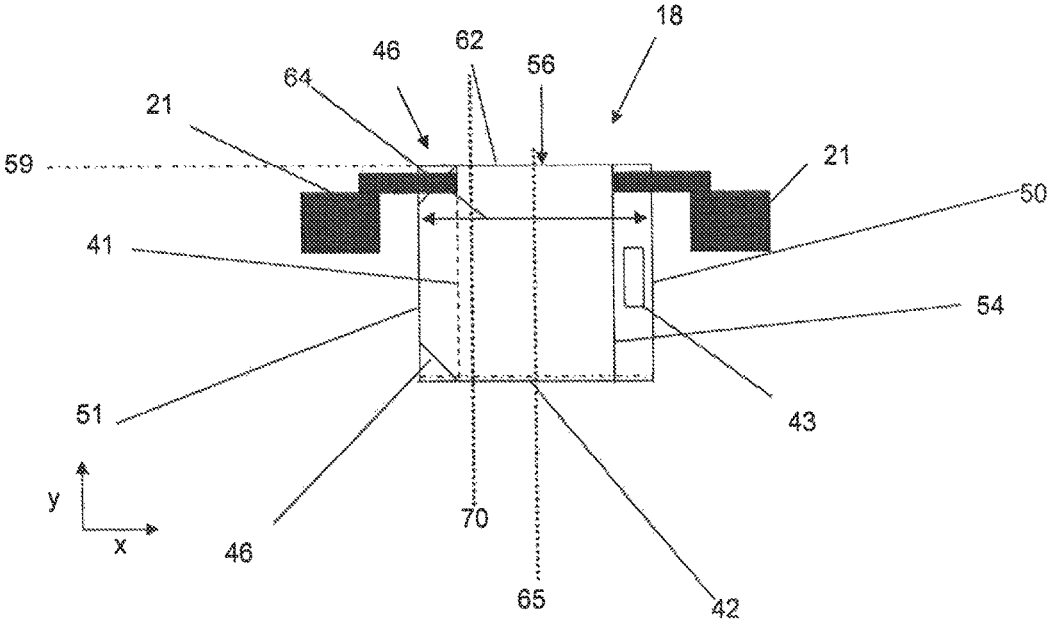

FIG. 3 shows an unfilled, hose section 18 open at one side. A majority of its features have already been mentioned in reference to the hose 4 in FIG. 1. Additionally the hose section 18 includes the corner welding seams 46, the zipper 54, and the lateral welding seam 42, which are implemented in the hose section 18 in the devices of a FFS machine provided for this purpose. The hose section 18 is suspended at the graspers 21 in the filling station and is ready to be filled via its opening 62 as indicated by the arrow 56.

FIG. 3 also shows that the axis of symmetry 70 of the filling nozzle 23 is off-set in reference to the primary axis of symmetry 65 of the hose.

FIG. 4 shows a filled bag 60. Further, it comprises once more the same features as the hose 4 in FIG. 2 and the hose section 18 in FIG. 3.

The bag 60 however rests on the hose edge 52, which comprises a lateral fold 41, here forming a more stable base. As already mentioned, a trapezoidal front surface of the filled bag forms, caused by the corner welding seams 46. Here, the corner welding seams in FIGS. 4 and 5 are shown arched, because in the filled bags 60 or hose sections, they are pressed against the exterior walls of the respective packaging semi-finished products 60, 18. The lateral welding seams 42, which were applied to the semi-finished bag 4, 18 on its path through the FFS machine, now form the lateral walls of the bag 60. FIG. 5 shows a hose part 18 already filled via its opening 62, which again shows a trapezoidal front view. The hose section is still suspended at the graspers 21. The alignment and shape of the support surface 58 has already been discussed. The cross section in FIG. 6 showing the direction of view (FIG. 5) indicated by the arrows 67 illustrates once more how the support surface 58 may be formed.

In FIGS. 5 and 6 the distance 61 is shown as a vertical distance (y) between the intersection of the bag opening 62 and the primary axis of symmetry 65 as well as the lowest point of the support surface 58 at the end of the contact area 71 to be activated. This point is of course simultaneously the point of the contact surface 71 to be activated, farthest apart from the bag opening.

Within the scope of the method according to the invention it is advantageous to fill the bag 60 with consumer products. These products include pet food and other goods for keeping pets, such as cat litter and the like. Bulk material, such as granular animal food, is particularly well suited.

It has shown that the features of the process and the device disclosed in the exemplary embodiments and the dependent claims are also advantageous when two successive separating lines are inserted in the hose (4) at a distance (61), this distance being smaller than the distance (64) between the two edges (50, 51) of the hose (4). This also applies when the device 1 is not further developed for the production of bags 60 in which the distance between the lateral welding seams 42 is smaller than the one between the edges 50 and 51.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

List of reference characters

| | |
|---|---|
| 1 | Device for producing and filling bags |
| 2 | Support arm |
| 3 | Roll |
| 4 | Film/tubular film/film hose |
| 5 | Conveyer roll |
| 6 | Deflection roll |
| 7 | Conveyer roll |
| 8, 8a | Conveyer roll |
| 9 | Lever |
| 10 | Piston-cylinder unit |

-continued

| List of reference characters | |
|---|---|
| 11 | |
| 12 | Cooling station |
| 13 | Lateral welding station |
| 14 | Parallelogram arrangement |
| 15 | Pair of feeding rolls |
| 16 | Lateral cutting station |
| 17 | Grasper |
| 18 | Hose section |
| 19 | Grasper |
| 20 | Filling station |
| 21 | Stationary grasper |
| 22 | Suction device |
| 23 | Filling nozzle |
| 24 | Conveyer belt |
| 25 | Grasper |
| 26 | Head or bottom welding seam station |
| 27 | Bag |
| 28 | Station for inserting handle holes |
| 29 | Register device |
| 33 | Welding bar |
| 41 | Lateral folds |
| 42 | Lateral welding seam |
| 43 | Handle hole |
| 46 | Corner welding seam |
| 50 | Edge of the film hose |
| 51 | Edge of the film hose |
| 52 | Longitudinal joint |
| 53 | Dot-dash circle |
| 54 | Slider |
| 56 | Filling via the opening 62 of the hose section 18 |
| 57 | Arrow "adjusting the support surface" |
| 58 | Support surface |
| 59 | Dot-dash line "height (y) of bag opening" |
| 60 | Bag |
| 61 | Arrow distance opening 62 of the hose section 18 support surface 58 in the vertical direction |
| 62 | Opening of the hose section |
| 63 | "Future separating cut" |
| 64 | Width of the hose |
| 65 | Primary axis of symmetry of the hose 4 or the hose sections 18 |
| 66 | Horizontal |
| 67 | Arrows "View FIG. 6" |
| 69 | Station to apply corner welding seams 26 |
| 70 | Symmetry line of the filling nozzle 23 |
| 71 | Contact area of the support surface 58 of the bag bottom support device to be activated |
| 72 | Shaker |

What is claimed is:

1. A method of producing and filling packaging, said method comprising:

unwinding a flattened tubular film material having a primary axis of symmetry and two edges parallel relative thereto from a roll along the primary axis of symmetry;

providing the flattened tubular film material with a longitudinal seam and a handle hole at one of the two edges thereof, the longitudinal seam extending parallel to the primary axis of symmetry and connecting a first side of a hose section of the flattened tubular film material to a second side of the hose section of the flattened tubular film material, and the handle hole being located between the longitudinal seam and one of the two edges of the flattened tubular film material;

providing the flattened tubular film material at the second side of the hose section thereof via a welding and separating process with a first lateral welding seam perpendicular relative to the primary axis of symmetry;

providing separating lines at the first and second sides in the flattened tubular film material perpendicular relative to the primary axis of symmetry and separated from each other by a distance that is less than a distance between the two edges thereof;

separating the flattened tubular film material along one of the separating lines so as to produce the individual hose section that is open at the first side thereof;

filling in a filling station via gravity with a material the hose section that is open at the first side thereof, and, with a bag bottom-support device, supporting the second side of the hose section during the filling process, with a contact area of a support surface of the bag bottom-support device having an inclination angle relative to a horizontal plane of transport of the hose section in the filling station, and perpendicular to a transport direction of the hose section, with the longitudinal seam preventing the filled material from escaping through the handle hole; and to provide a finished, filled sack, providing the open first side of the hose section with a second lateral welding seam extending perpendicular relative to the primary axis of symmetry.

2. The method according to claim 1, further comprising providing an opening aid in at least one of the two edges of the hose section.

3. The method according to claim 2, wherein the opening aid is at least partially provided during the step of producing the hose section.

4. The method according to claim 3, wherein the opening aid includes a resealing closure.

5. The method according to claim 4, wherein the resealing closure includes a slider.

6. The method according to claim 5, wherein the slider includes a slider bar and a slider head, and wherein the slider bar is provided during the step of producing the hose section, and the slider head is placed upon the slider bar after the flattened tubular film material has been unwound from the roll.

7. The method according to claim 2, wherein the opening aid is provided in the hose section via a perforation therein.

8. The method according to claim 1, wherein the handle hole is provided while the unwound flattened tubular film material is being intermittently conveyed.

9. The method according to claim 1, further comprising applying two corner welding seams in at least one of the two edges of the flattened tubular film material prior to or after the step of separating the flattened tubular film material into the hose section.

10. An apparatus for the production and filling of packaging from a flattened tubular film material having a primary axis of symmetry and two matching edges, with a distance of the edges from each other representing an operating width, and the apparatus having a maximum operating width, said apparatus comprising:

an unwinding device with which the flattened tubular film material is unwound from a roll along the primary axis of symmetry of the flattened tubular film material;

a device for providing the flattened tubular film material with a longitudinal seam, the longitudinal seam extending parallel to the primary axis of symmetry and connecting a first side of a hose section of the flattened tubular film material to a second side of the hose section of the flattened tubular film material;

a device for providing the flattened tubular film material with a handle hole at one of the two edges thereof, the handle hole being located between the longitudinal seam and one of the two edges of the flattened tubular film material;

a device for providing separating lines at the first and second sides in the flattened tubular film material perpendicular relative to the primary axis of symmetry and separating the flattened tubular film material along one of the separating lines so as to provide the hose section;

a device for providing a first lateral welding seam in the flattened tubular film material at the second side thereof, the first lateral welding seam extending perpendicular relative to the primary axis of symmetry;

a filling station with which the hose section, open at the first side thereof, is filled via gravity with a material, with the hose section being held by stationary graspers;

a bag bottom-support device with which the second side of the hose section is supported during the filling process, the bag bottom-support device being adjustable such that a distance between a support surface of the bag bottom-support device and the stationary graspers relative to each other in a vertical direction is less than or equivalent to the maximum operating width of the apparatus, with a contact area of the support surface of the bag bottom-support device having an inclination angle relative to a horizontal plane of transport of the hose section in the filling station, and perpendicular to a transport direction of the hose section, and with the longitudinal seam preventing the filled material from escaping through the handle hole; and a device for sealing the open first side of the filled hose section by providing a second lateral welding seam in the hose section extending perpendicular relative to the primary axis of symmetry.

11. The apparatus according to claim 10, further comprising at least one of a corner welding device with which only one of the two edges of at least one of the flattened tubular film material and the hose section is processed.

12. The apparatus according to claim 10, further comprising a corner welding device with which both of the edges of at least one of the flattened tubular film material and the hose section is processed, with the corner welding device being switchable between processing one of the edges and processing both of the edges.

13. The apparatus according to claim 10, further comprising a filling nozzle, with a line of symmetry of the filling nozzle of the filling station being off-set relative to the primary axis of symmetry of the hose section in the filling station, or with a relative position of the line of symmetry of the filling nozzle being off-set relative to the primary axis of symmetry of the hose section.

14. An apparatus for the production and filling of packaging from a flattened tubular film material having a primary axis of symmetry and two matching edges, with a distance of the edges from each other representing an operating width, and the apparatus having a maximum operating width, said apparatus comprising:

an unwinding device with which the flattened tubular film material is unwound from a roll along the primary axis of symmetry of the flattened tubular film material;

a device for providing the flattened tubular film material with a longitudinal seam extending parallel to the primary axis of symmetry and connecting a first side of a hose section of the flattened tubular film material to a second side of the hose section of the flattened tubular film material;

a device for providing the flattened tubular film material with a handle hole at one of the two edges thereof;

a device for providing separating lines at the first and second sides in the flattened tubular film material perpendicular relative to the primary axis of symmetry and separating the flattened tubular film material along one of the separating lines so as to provide the hose section;

a device for providing a first lateral welding seam in the flattened tubular film material at the second side thereof, the first lateral welding seam extending perpendicular relative to the primary axis of symmetry;

a filling station with which the hose section, open at the first side thereof, is filled by gravity with a material via a filling nozzle, with the hose section being held by stationary graspers, and with an axis of symmetry of the filling nozzle and the primary axis of symmetry of the hose section being off-set relative to one another;

a bag bottom-support device with which the second side of the hose section is supported during the filling process, the bag bottom-support device being adjustable such that a distance between a support surface of the bag bottom support device and the stationary graspers relative to each other in a vertical direction is less than or equivalent to the maximum operating width of the apparatus, with a contact area of the support surface of the bag bottom-support device having an inclination angle relative to a horizontal plane of transport of the hose section in the filling station, and perpendicular to a transport direction of the hose section; and a device for sealing the open first side of the filled hose section by providing a second lateral welding seam in the hose section extending perpendicular relative to the primary axis of symmetry.

15. An apparatus for the production and filling of packaging from a flattened tubular film material having a primary axis of symmetry and two matching edges, with a distance of the edges from each other representing an operating width, and the apparatus having a maximum operating width, said apparatus comprising:

an unwinding device with which the flattened tubular film material is unwound from a roll along the primary axis of symmetry of the flattened tubular film material;

a device for providing the flattened tubular film material with a longitudinal seam extending parallel to the primary axis of symmetry and connecting a first side of a hose section of the flattened tubular film material to a second side of the hose section of the flattened tubular film material;

a device for providing the flattened tubular film material with a handle hole at one of the two edges thereof, with the device for providing longitudinal seam and the device for providing the handle hole being combined within a same station;

a device for providing separating lines at the first and second sides in the flattened tubular film material perpendicular relative to the primary axis of symmetry and separating the flattened tubular film material along one of the separating lines so as to provide the hose section;

a device for providing a first lateral welding seam in the flattened tubular film material at the second side thereof, the first lateral welding seam extending perpendicular relative to the primary axis of symmetry;

a filling station with which the hose section, open at the first side thereof, is filled via gravity with a material, with the hose section being held by stationary graspers;

a bag bottom-support device with which the second side of the hose section is supported during the filling process, the bag bottom-support device being adjustable such that a distance between a support surface of the bag bottom-support device and the stationary graspers relative to each other in a vertical direction is less than or equivalent to the maximum operating width of the apparatus, with a contact area of the support surface of the bag bottom-support device having an inclination angle relative to a horizontal plane of transport of the hose section in the filling station, and perpendicular to a transport direction of the hose section; and a device for sealing the open first side of the filled hose section by providing a second lateral welding seam in the hose section extending perpendicular relative to the primary axis of symmetry.

* * * * *